United States Patent [19]

Hughes

[11] 4,388,510

[45] Jun. 14, 1983

[54] HEATING COLLAR WITH QUADRAFILAR WINDINGS

[75] Inventor: William L. Hughes, Stillwater, Okla.

[73] Assignee: Commercial Resins Company, Tulsa, Okla.

[21] Appl. No.: 273,233

[22] Filed: Jun. 12, 1981

[51] Int. Cl.[3] ..... H05B 6/10; H05B 6/44

[52] U.S. Cl. ..... 219/8.5; 219/10.79; 219/10.75; 219/10.57; 336/138; 336/147

[58] Field of Search ..... 219/8.5, 9.5, 10.79, 219/10.75, 10.57, 10.49 R; 336/138, 139, 140, 144, 145, 147, 127, 180, 116, 65, 67, 75

[56] References Cited

U.S. PATENT DOCUMENTS

| | | | |
|---|---|---|---|
| 1,813,591 | 7/1931 | Ulrey | 219/10.79 |
| 2,933,584 | 4/1960 | Thielsch | 219/10.79 |
| 3,007,022 | 10/1961 | Jackson et al. | 219/8.5 X |
| 3,166,664 | 1/1965 | Paton et al. | 219/8.5 X |
| 3,311,732 | 3/1967 | Stein et al. | 219/10.79 X |

*Primary Examiner*—B. A. Reynolds
*Assistant Examiner*—Philip H. Leung
*Attorney, Agent, or Firm*—William S. Dorman

[57] ABSTRACT

Apparatus for producing induction currents in a pipe to heat the same comprising an axially extending collar adapted to removably surround the pipe, the collar including at least two arcuate frames hingedly connected in end to end circumferential relationship and having a pair of free ends adapted to be opened for placing the frames around the pipe, a plurality of electrically conducting wires carried upon the frames across the axial width thereof and extending circumferentially between the free ends, a connector assembly mounted at each free end, each connector assembly having a plurality of connectors, each connector of each assembly being connected to an end of a wire and being connected electrically to a connector of the other assembly when the frames are in closed position around the pipe, the wires on one axial half of the collar being connected to each other to form two interlaced bifilar windings; the wires at the other axial end of the collar being interconnected to form two interlaced bifilar windings arranged in end to end axial relationship with the bifilar windings of the first axial end of the collar thereby resulting in an overall quadrafilar winding for the collar, and a source of alternating electric potential connected to the windings to produce induction heating in the pipe.

2 Claims, 7 Drawing Figures

HEATING COLLAR WITH QUADRAFILAR WINDINGS

BACKGROUND OF THE INVENTION

1. Field of the Invention

This invention relates to a heating collar for heating a pipe or the like by induction heating; more particularly this invention relates to a heating collar having four separate, but cooperating, coils or windings.

2. Background of the Invention

In many processes, in the fabrication and construction of pipes or pipelines, or in the application of coating and the like to such pipes, it is frequently desirable to preheat the pipe in the predetermined area or zone to be treated such as in welding, pipe coating and similar processes. Such zonal heating has been effected in the past, for example, by applying a torch flame to the area to produce the desired heat. However, the heating effects produced by a torch flame are highly localized, and are not suitable for many processes which require a uniform heat application, for instance, around the circumference of the pipe.

For example, in field performed processes in which a coating of epoxy or the like is sprayed onto a previously welded pipe joint, the entire area of the joint to be coated should be uniformly and evenly preheated to a temperature of 300°-500° F. prior to the application of he coating material to enable a desired uniform epoxy coat of, for instance, 25-35 mils to be deposited. Such coating processes are used, for instance, in applications in which pipes are provided with a protective epoxy coat, except for its ends at which welding to adjacent pipe sections in the field is effected. After the welding process, the uncoated joint is coated with epoxy to thereby effect a pipe coated along the entire length of the pipe, including the welded junction, for resisting corrosion and other deleterious influences to which the pipe may be subjected. Uneven heat, such as by torch preheating, may produce uneven or unreliable coatings, which may result in areas of the pipe being undesirably exposed to the elements, resulting in premature pipeline failures. The torch preheating also is slow to perform, usually done manually, and requires carrying the torch and its accessories from each joint to the next.

SUMMARY OF THE INVENTION

The present invention provides a heating apparatus or collar for producing induction currents in a pipe or the like to heat it. This heating collar includes a pair of hinged frames adapted to be removably located or positioned around a pipe. A plurality of electrically conducting wires are carried upon the frames, each wire (except as indicated hereinafter) extending substantially between the unhinged ends of the frames to each encircle the pipe when the collar is closed around the pipe. A plurality of connectors are mounted in the frames to connect one end of each wire to an end of another wire, except for a first and a last wire of each winding, to define four continuous electrically conducting windings around the pipe. The first and last wires of each winding are connected to a source of alternating electrical potential.

DESCRIPTION OF THE PREFERRED EMBODIMENTS

Figure 1:
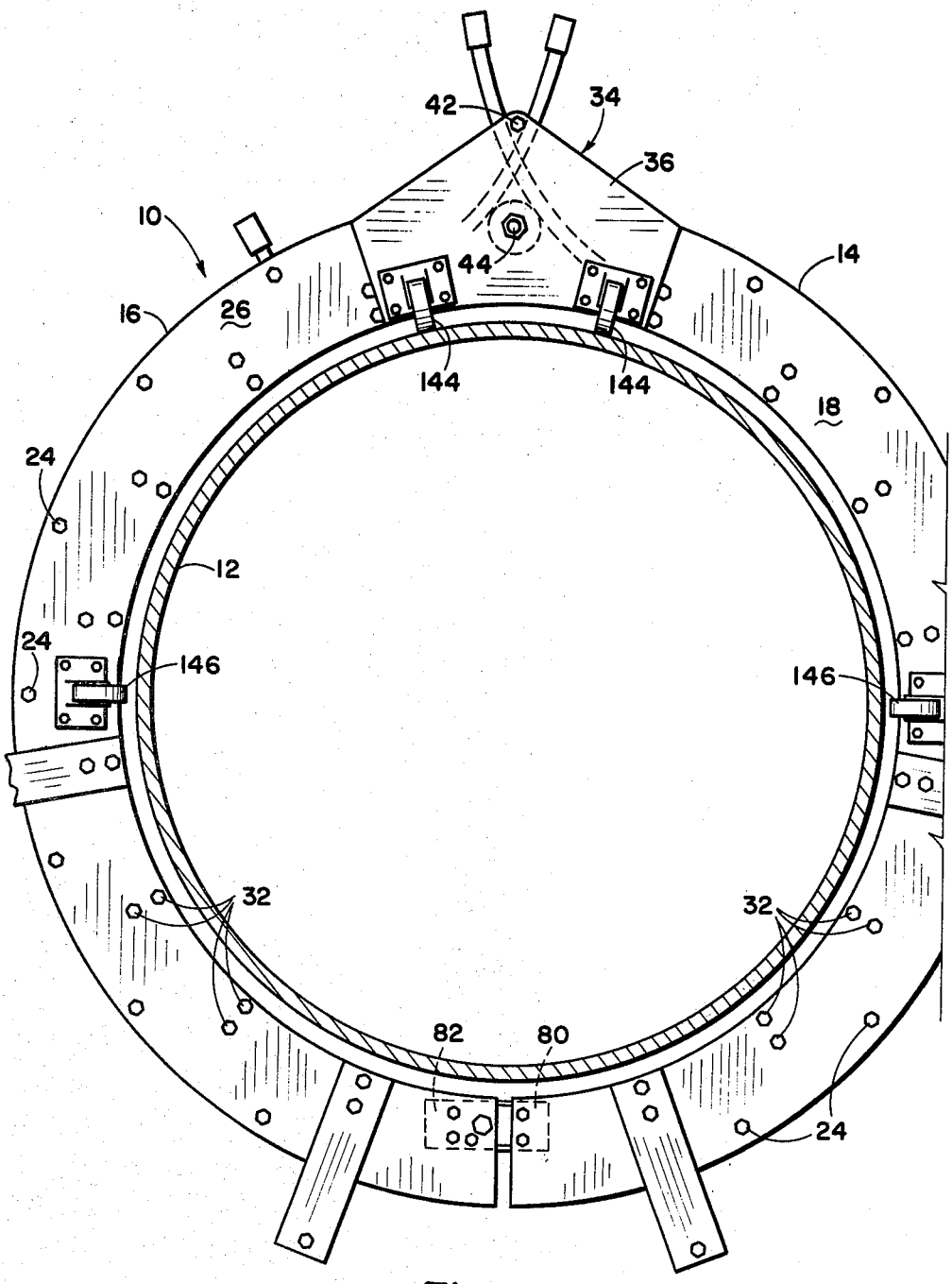
FIG. 1 is a front elevational view of a heating apparatus of the present invention shown in closed position around a pipe which is indicated in cross-section.
Figure 2:
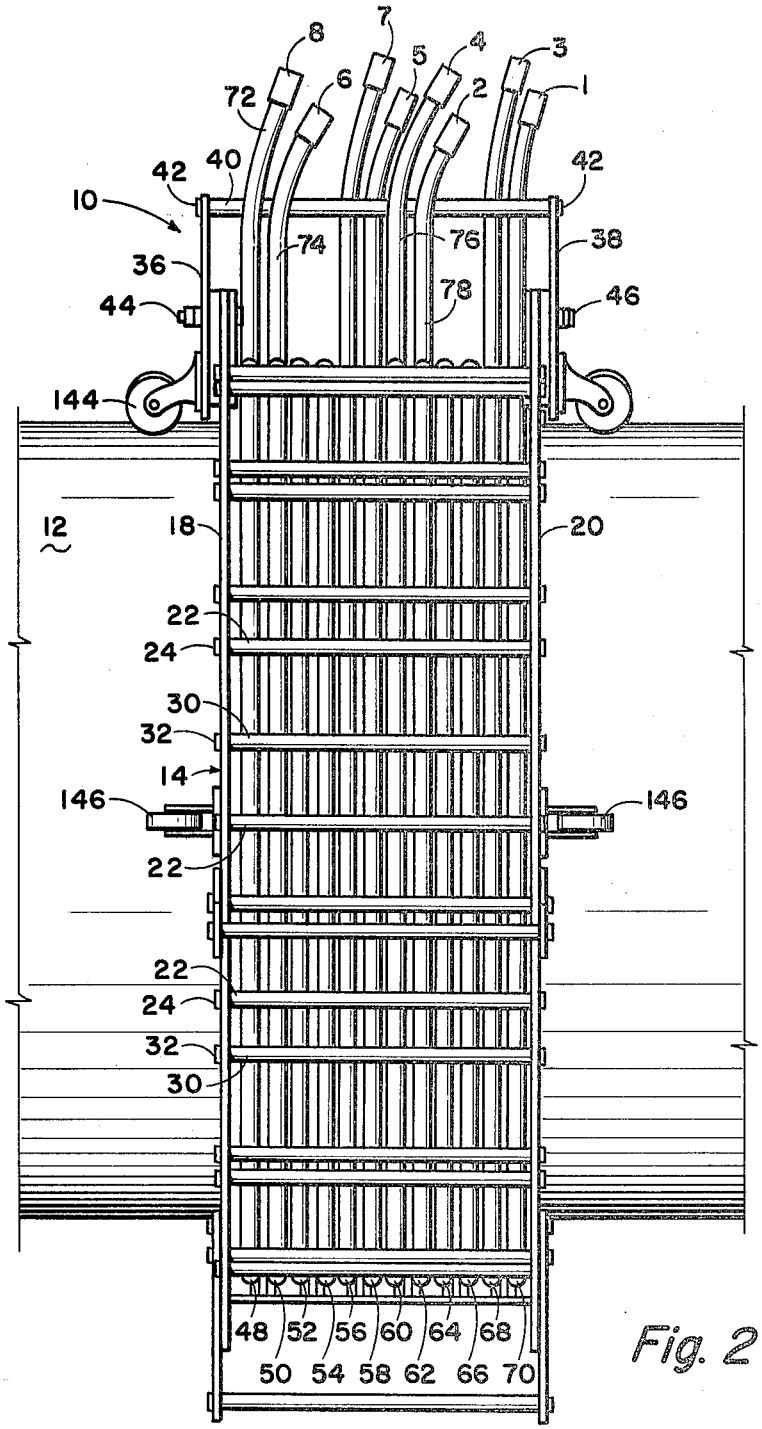
FIG. 2 is a side elevational view of the heating apparatus shown in FIG. 1.

Referring to FIGS. 1 and 2, a heating apparatus is shown in the form of a hinged collar 10 encircling a pipe 12 to be heated. The collar extends over the pipe both circumferentially, as shown in FIG. 1, and axially (parallel to the axis of the pipe), as shown in FIG. 2. The collar 10 is comprised of a plurality of arcuate shaped sections, such as the two semi-circular frames 14 and 16, hinged together at the top in a manner later to be described. These semi-circular frames 14 and 16 are substantially identical except for their interconnecting bottom ends, also later to be described. The frame 14 is formed from two semi-circular plates 18 and 20 which are interconnected and held in spaced parallel relationship by means of outer rods 22 which are bolted to the semi-circular plates 18 and 20 by means of bolts 24. Similarly, the semi-circular frame 16 is formed by semi-circular plates 26 and 28 which are interconnected and held in spaced apart relationship by means of outer rods 22 (not shown) which are bolted to the semi-circular plates 26 and 28 by means of bolts 24. Each arcuate frame member, 14 or 16, is provided with a pair of circularly arranged and parallel rows of inner rods 30 which are connected to the arcuate plates 18 and 20, and 26 and 28, by means of bolts 32. The wires, later to be described, are wound on the frame members between the two inner rows of rods 30 and, therefore, only the outer row of rods 30 appears in FIG. 2.

The hinged connection between the semi-circular frames 14 and 16 comprises a hinge frame 34 which includes triangular members 36 and 38 disposed outside of the frames 14 and 16 and interconnected by means of a securing rod 40 which is bolted to the triangular members 36 and 38 by means of bolts 42. The triangular frame member 36 is bolted by means of bolt 44 to the semi-circular plates 18 and 26; the bolt 44 passes through overlapping portions of the semi-circular plates 18 and 26 and, therefore, provides a pivot point for the forward portion of the frame assembly as shown. Similarly, the triangular plate 38 is bolted to the semi-circular plates 20 and 28 by means of a bolt 46 which also passes through overlapping portions of these semi-circular plates and, therefore, provides the pivot point for the rear portion of the frame members 14 and 16. A plurality of wires 48, 50, 52, 54, 56, 58, 60, 62, 64, 66, 68 and 70 are carried on the frame between the inner and outer rows of rods 30 and cover substantially the entire axial width of the collar, as shown in FIG. 2. Wires 48 through 54 inclusive and wires 60 through 66 inclusive extend for the full circumference of the collar from the male connector box to the female connector box, as will be described hereinafter. Wires 68 and 70 connect from the male connector box, as will hereinafter appear, and extend counterclockwise to terminals 3 and 1, respectively, as will be explained hereinafter. Wires 56 and 58, similarly, extend counterclockwise from the male connector box to terminals 7 and 5, respectively, as will be explained hereinafter. On the rear side of the collar 10, that is, from the rear of FIG. 2, a pair of wires 72 and 74 (the major portions of which are hidden) extend in a clockwise direction from the female connector box to terminals 8 and 6, respectively. Similarly, another pair of wires 76 and 78 (the major portions of which are hidden in FIG. 2) extend in a clockwise direction from the female connector assembly to terminals 4 and 2, respectively.

Figure 4:
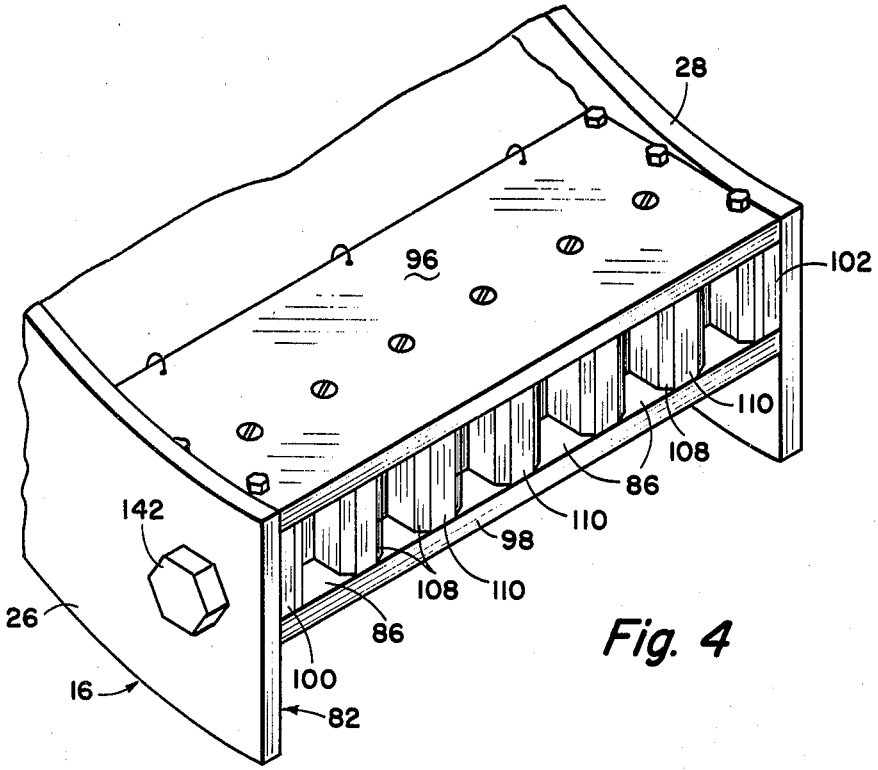
FIG. 4 is a perspective view of one form of the female connector assembly for use with the heating apparatus of FIG. 1.
Figure 3:
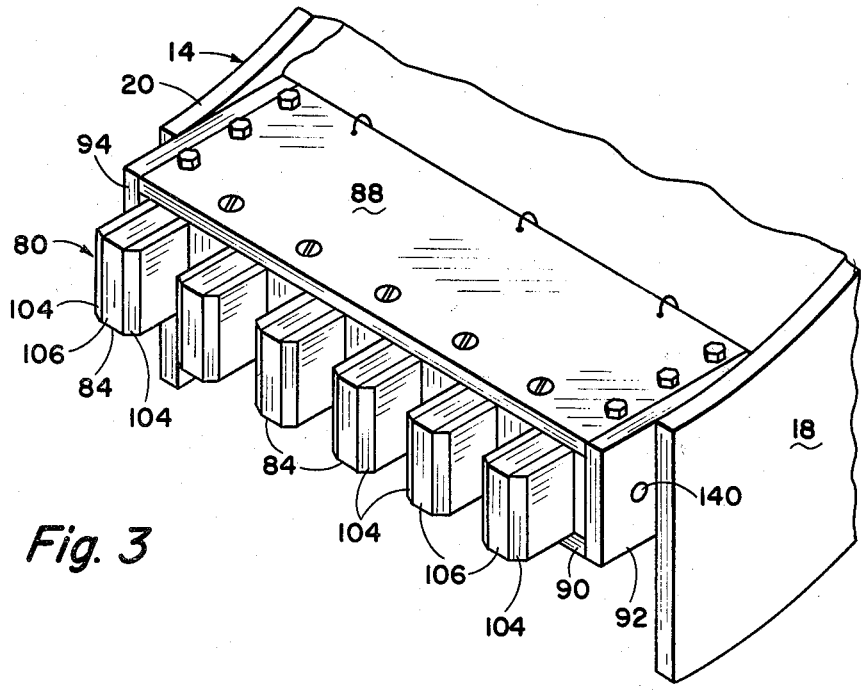
FIG. 3 is a perspective view of one form of the male connector assembly for use with the heating apparatus of FIG. 1.
Figure 5:
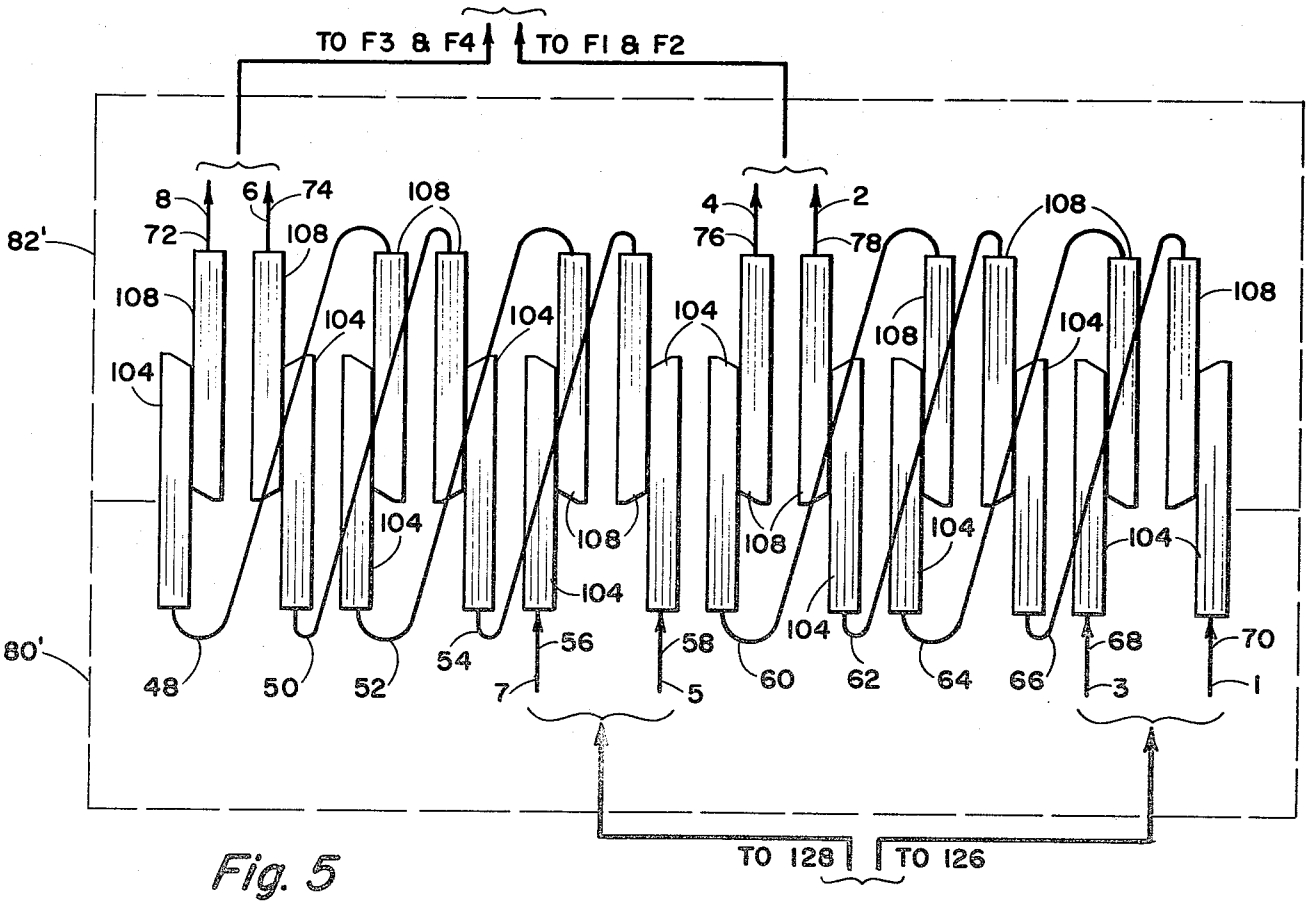
FIG. 5 is a semi-diagrammatic view of the various connections for the wires on the heating apparatus to show the formation of four separate windings.

Referring now to FIGS. 1, 3 and 4, the lower portion of the right hand hinge assembly 14 includes a male connector box assembly 80, shown in FIG. 3, while the lower portion of the left hand hinge assembly 16 includes a female connector box or assembly 82, shown in FIG. 4. The male and female assemblies 80 and 82, shown in FIGS. 3 and 4, respectively, are illustrated in these figures in a simplified form, it being understood that FIG. 5 shows a diagrammatic representation of a modified form of these assemblies. At any event, the male assembly 80 consists of a plurality of projections 84 adapted to be received in corresponding recesses 86 in the female connector assembly 82, shown in FIG. 4.

The male connector assembly 80 is contained in an insulating box defined by upper and lower non-conducting plates 88 and 90 and non-conducting side plates 92 and 94. The side plates 92 and 94 are connected to the arcuate plates 18 and 20, respectively, by means of bolts or screws (not shown). Likewise, the female connector assembly 82 is contained in an insulating box consisting of upper and lower non-conducting plates 96 and 98, respectively, and non-conducting side plates 100 and 102, the sides 100 and 102 being connected to the semicircular plates 26 and 28, respectively.

Each projection 84 on the male conductor assembly is provided with a pair of electrically conducting plates 104 spaced apart apart and separated by an insulating plate 106. In similar fashion, each recess 86 is provided with electrically conducting plates 108 at the sides thereof, and adjacent recesses are separated by non-conducting plates 110. When the heating collar is placed in the position shown in FIG. 1, the projections 84 on the male connector assembly 80 are received in the recesses 86 in the female connector assembly 82 at which time the conducting plates 104 of the male conductor assembly are in contact with the conducting plates 108 of the female connector assembly.

In the modified form shown in FIG. 5, the male connector assembly 80′ is provided with narrower projections at the ends formed by single conducting plates 104 which are received in correspondingly narrower recesses at the ends of the female connector assembly 82′, it being understood that the portions of the female connector assembly outboard of the end conducting plates 104 are formed of non-conducting material.

With the arrangement shown in FIG. 5, there are four windings on the collar 10 as follows: terminal 1 connects through wire 70 (see also FIG. 2) into the male connector assembly 80′ to the left hand conducting plate 104 through the next adjacent conducting plate 108 on the female connector assembly 82′ through the wire 66 through conducting plates 104 and 108 to wire 62, through conducting plates 104 and 108 to wire 78 and to terminal 2; the second coil or winding extends from terminal 3 through wire 68 to the male connector assembly 80′ through conducting plates 104 and 108, through wire 64 through conducting plates 104 and 108, through wire 60 through conducting plates 104 and 108, through wire 76 to terminal 4; the third coil extends from terminal 5 through wire 58 to the male connector box 80′ through conducting plates 104 and 108, through wire 54 through conducting plates 104 and 108, through wire 50 through conducting plates 104 and 108, through wire 74 to terminal 6; the fourth coil or winding extends from terminal 7 through wire 56 to the male connector assembly 80′ through conducting plates 104 and 108, through wire 52 through conducting plates 104 and 108, through wire 48 through conducting plates 104 and 108, through wire 72 to terminal 8. Thus, the coil extending between terminals 1 and 2 is interlaced between the coil or winding extending between terminals 3 and 4, or, in other words, is in a bifilar arrangement. The coil or winding extending between terminals 5 and 6 is interlaced with the coil or winding extending between terminals 7 and 8 and, therefore, is also in a bifilar arrangement. Since these two bifilar arrangements are disposed in end to end relationship, the ultimate result is a quadrafilar arrangement.

Figure 6:
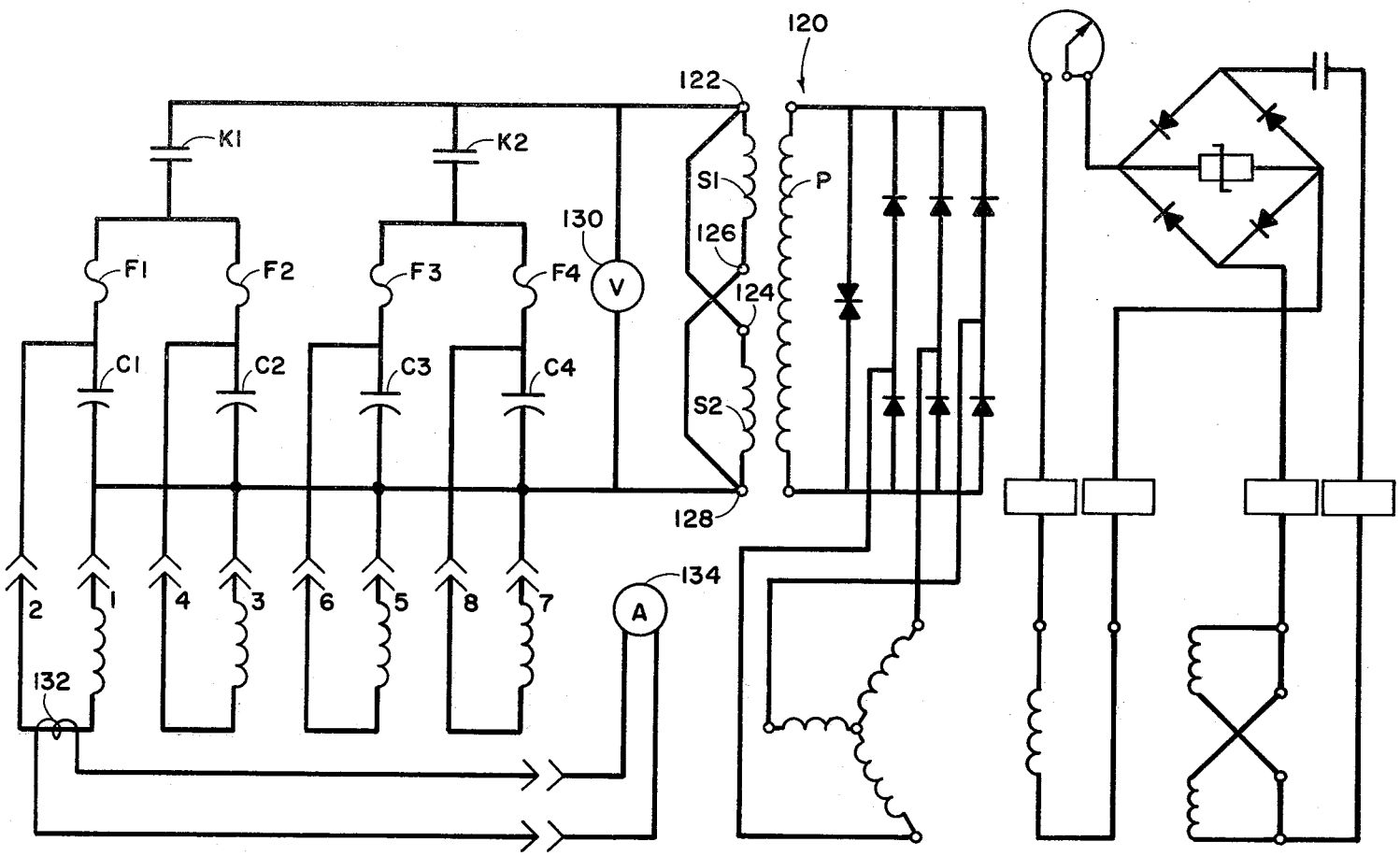
FIG. 6 is an electrical circuit diagram of the power source and its connections to the windings of FIG. 5.

Referring now to FIG. 6, there is shown a circuit diagram which includes a power generator generally designated by the reference numeral 120. This power generator is basically in the form of a brushless alternator having a single primary winding P and a pair of secondaries S1 and S2. The construction of this power generator is such that it is capable of delivering 50 KVA preferably at a frequency of about 800 cycles. If the two secondaries S1 and S2 were connected in series as shown, the generator 120 would be capable of delivery 220 volts. However, under the circumstances where the present invention was employed, the requirements were that the voltage should not exceed 110 volts. Accordingly, the secondaries S1 and S2 of FIG. 6 have been connected to the circuit of FIG. 5 in the following manner.

The upper terminal 122 of the secondary S1 is connected to the upper terminal 124 of the secondary S2 and the lower terminal 126 of the secondary S1 is connected to the lower terminal 128 of the secondary S2. The upper terminal 122 is also connected through contactor K1, through fuses F1 and F2 to terminals 2 and 4, respectively; the upper terminals 122 and 124 are also connected through contactor K2, through fuses F3 and F4 to terminals 6 and 8, respectively. The lower terminals 126 and 128 connect with terminals 1, 3, 5 and 7 thereby providing a source of 110 volts alternating current for the four coils or windings on the collar. If desired, the voltage to the coils or windings can be measured by means of a voltmeter 130 which is placed across the output terminals of the two secondaries. If it is desired to measure the current to any one of the four windings, a current transformer 132 can be placed around any one of the wires leading to a given winding and the amount of current through that particular wire can be measured by an ammeter 134 which is connected to the current transformer 132. Capacitors C1, C2, C3 and C4 are placed across the windings as shown.

Figure 7:
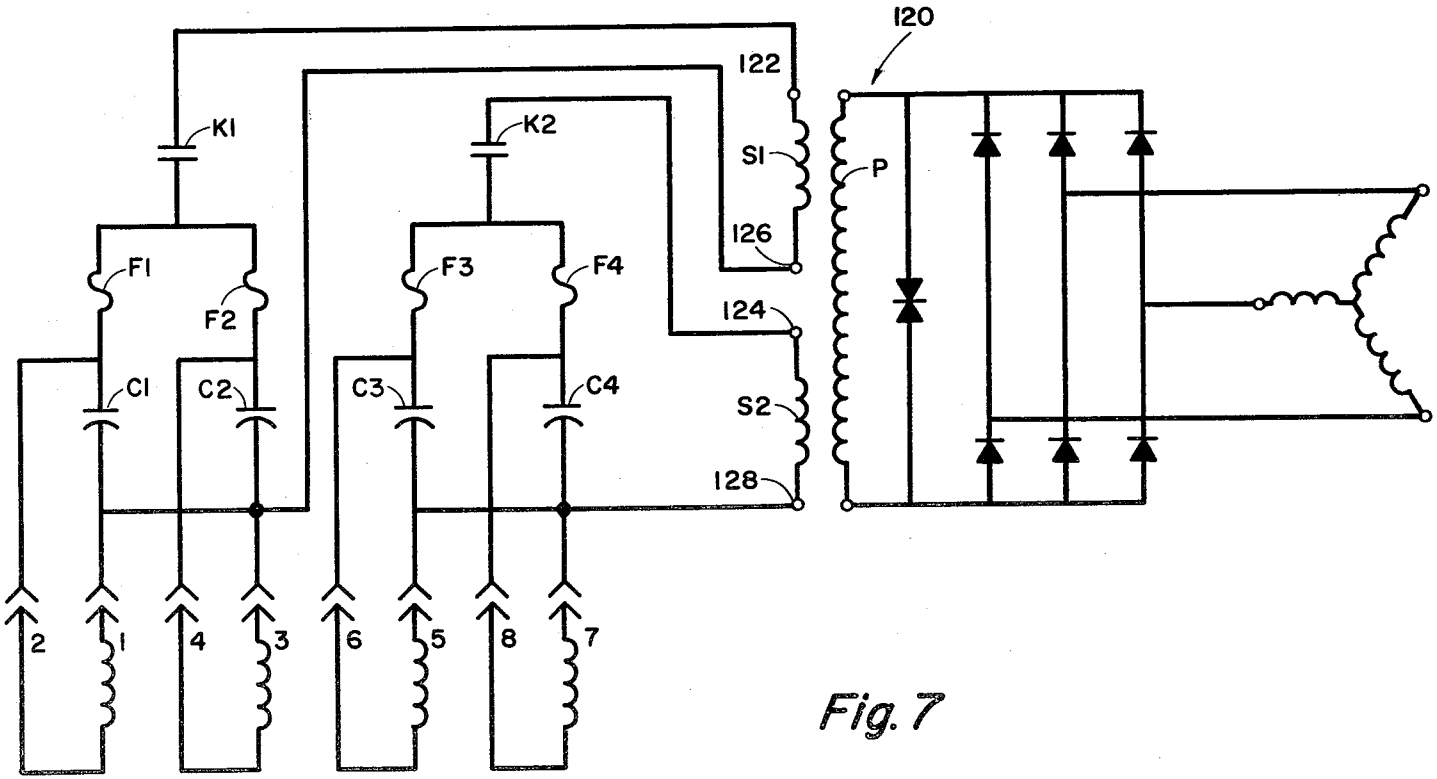
FIG. 7 is a modified form of the circuit diagram shown in FIG. 6.

The circuit of FIG. 7 shows an arrangement where the secondaries of the power transformer 120 are not connected to each other and are feeding two separate windings each on the heating collar. As shown in FIG. 7, the upper terminal 122 connects through the contactor K1 and through the fuses F1 and F2 to the terminals 2 and 4 only. The lower terminal 126 of the secondary S1 feeds into terminals 1 and 3 only. The upper terminal 124 of the secondary S2 feeds through contactor K2, fuses F3 and F4, to terminals 6 and 8 only and the lower terminal 128 of the secondary S2 feeds to terminals 5 and 7 only. In this way, the windings extending from terminals 1 and 2 and terminals 3 and 4 are fed separately from the windings extending between terminals 5 and 6 and terminals 7 and 8.

Returning now to a further consideration of FIGS. 3 and 4, in order to maintain the electrically conductive and insulating blocks and plates in their relative positions, an insulating rod is provided through each of the parallel alignments of the plates; insulating rod 140, for example, extends through the side insulating plates 92 and 94 of the insulating box of the male connector assembly and also extends through the intermediate conducting plates 104 and non-conducting plates 106 and any other insulating blocks interposed in the arrangement; a similar insulating rod (not shown) is employed to maintain the relative location of the insulating plates and blocks and conducting plates on the female connector assembly 82. A tightening nut 142 is provided on the side of the female connector assembly. This nut has a shank (not shown) which is threadedly received in a hole in the semi-circular plate 26, and this shank extends inwardly into contact with a metal plate (not shown) which bears against the insulating plate immediately inboard of the semi-circular plate 26. Thus, by tightening the nut 142 a compressive force can be exerted across the entire assembly when the male and female connectors are disposed in their interdigitated relationship thereby locking the collar in the position shown in FIG. 1.

When the heating collar is placed upon and around a pipe 12 as shown in FIG. 1, top rollers 144 will support the heating collar 10 on the pipe 12 and will also permit the collar to be rolled along the length of the pipe for a limited distance. Side rollers 146 do not necessarily contact the side of the pipe 12 but serve to keep the collar 10 generally centrally disposed around the pipe and prevent scraping of the sides of the collar 10 against the sides of the pipe.

The wires forming the various windings or coils on the collar 10 are preferably of "double O" gauge copper with an insulating coat thereon. With the generator shown in FIGS. 6 and 7, this arrangement should be capable of heating a pipe of iron containing material to between approximately 300°–500° F. or higher.

In operation, the heating collar 10 is placed in an encircling arrangement around the pipe 12 by first opening the semi-circular frames 14 and 16 about the hinge 34. The collar 10 is then lowered onto the pipe 12 until the rollers 144 come to rest upon the top surface of the pipe. The collar is then closed by placing the connector assemblies in the closed position shown in FIG. 1 after which the nut 142 is tightened. The circuit shown in FIG. 6 or 7 is then actuated after the proper connections have been made and the pipe can be heated to the desired temperature, for example, 500° F. After the pipe is heated, it is ready for the subsequent steps to be formed, such as depositing the epoxy coating or welding the preheated joint, etc. The heating collar can be easily moved from the preheating area by merely rolling the collar 10 along the axis of the pipe 12 upon the rollers 144. The heating collar can then be located at the next junction to be heated or, alternatively, the coil can easily be removed by first loosening the nut 142 and opening up the hinged sections and lifting the collar off the pipe.

Whereas the present invention has been described in particular relation to the drawings attached hereto, it should be understood that other and further modifications, apart from those shown or suggested herein, may be made within the spirit and scope of this invention.

What is claimed is:

1. Apparatus for producing induction currents in a pipe to heat the same comprising an axially extending collar adapted to removably surround said pipe, said collar including at least two arcuate frames hingedly connected in end to end circumferential relationship and having a pair of free ends adapted to be opened for placing the frames around the pipe, a plurality of electrically conducting wires carried upon said frames across the axial width thereof and extending circumferentially between the free ends, a connector assembly mounted at each free end, each connector assembly having a plurality of connectors, each connector of each assembly being connected to an end of a wire and being connected electrically to a connector of the other assembly when the frames are in closed position around the pipe, the wires on one axial half of said collar being connected to each other to form two interlaced bifilar windings; the wires at the other axial end of the collar being interconnected to form two interlaced bifilar windings arranged in end to end axial relationship with the bifilar windings of the first axial end of the collar thereby resulting in an overall quadrafilar winding for the collar, means for connecting the bifilar windings at one axial end of said collar to a source of alternating electric potential to produce induction heating in the pipe, and means for connecting the bifilar windings at the other axial end of the collar to a source of alternating electric potential to produce induction heating in the pipe.

2. Apparatus of claim 1 wherein all four windings are connected in parallel.

* * * * *